US005445094A

United States Patent [19]

Kai et al.

[11] Patent Number: 5,445,094

[45] Date of Patent: Aug. 29, 1995

[54] WORKING APPARATUS TRAVELING THROUGH TANK WEB FRAME OF SHIP

[75] Inventors: Katsumi Kai, Mitaka; Kenji Okamoto, Yokohama; Yuuichi Miura, Funabashi, all of Japan

[73] Assignee: Ishikawajima-Harima Heavy Industries Co., Ltd., Japan

[21] Appl. No.: 237,879

[22] Filed: May 4, 1994

[30] Foreign Application Priority Data

Nov. 25, 1993 [JP] Japan ..... 5-294829
Nov. 25, 1993 [JP] Japan ..... 5-294830

[51] Int. Cl.[6] ..... B63B 3/00

[52] U.S. Cl. ..... 114/65 R; 414/143.2; 212/309

[58] Field of Search ..... 114/65 R, 77 R, 77 A, 114/201 R, 72; 212/210; 414/143.2, 137

[56] References Cited

U.S. PATENT DOCUMENTS 3,842,773 10/1974 Kurose et al. ..... 114/65 R
4,182,253 1/1980 Bordes ..... 212/210

*Primary Examiner*—Jesus D. Sotelo
*Attorney, Agent, or Firm*—Cushman Darby & Cushman

[57] ABSTRACT

A working apparatus comprising openings formed as gondola access holes in tank web frame of a ship, a rail passed through the openings and secured to the tank web frame, a trolley adapted to travel along the rail, a hoist mounted on the trolley, and a gondola elevatably suspended from the hoist is provided. The working apparatus can transport workers or necessary articles to a working place to be inspected or repaired for carrying out the inspection and/or repair within tanks of a ship.

12 Claims, 13 Drawing Sheets

WORKING APPARATUS TRAVELING THROUGH TANK WEB FRAME OF SHIP

FIELD OF THE INVENTION

The present invention relates to a working apparatus traveling through a tank web frame of a ship and more particularly to a traveling working apparatus to be installed within a tank such as a ballast tank for carrying out inspection and/or repair of the structure within the tank.

DESCRIPTION OF THE PRIOR ART

Ships such as an large tanker or a ore carrier for carrying bulk cargo such as ore or grain are provided with longitudinal bulk head. FIG. 13 shows a left-half cross-section of a middle hull portion of a conventional large tanker. In FIG. 13, a reference numeral "1" denotes a side shell plating, "2" denotes an upper deck, "3" denotes a longitudinal frame, "4" denotes a ship's bottom, "5" denotes a longitudinal bulkhead, "6" denotes a flat, "7" denotes a cargo tank, and "8" denotes a ballast tank.

That is, there are provided four longitudinal bulkhead 5 and three cargo tanks 7 are formed by the four longitudinal bulkhead 5 and both sides have shell plating 1. Side shell plating 1 and a longitudinal bulkhead 5 are arranged at one side form a ballast tank 8. Each of the side shell plating 1 and the longitudinal bulkhead 5 is provided with longitudinal frames 3 running along a length of the hull for preventing a deflection of the plating. Flats 6 forming horizontal plating are mounted within the ballast tanks 8 and used for inspecting the inside of the tanks.

In recent years, since damages caused within tanks are increased and thus regulations prescribing the detailed inspection of inside structures within tanks have been established, it is necessary to provide an inspecting apparatus not only on newly built ships but on presently working ships.

The following methods have been adopted for inspecting inside surfaces of the side shell plating forming tanks and longitudinal bulkhead.

(1) A first method is a RAFT system wherein the inspection is carried out by a RAFT (an inflatable boat) floated on water in a tank and vertically movable by changing the water level; (2) a second method is a fixed-ladder system wherein the inspection is carried out by using a ladder secured within a tank; (3) a third method is a temporary scaffold system wherein the inspection is carried out by using a temporarily mounted scaffold; and (4) a fourth method is a flat system wherein the inspection is carried out by using flats 6 (horizontal flats shown in FIG. 13) mounted at a some pitch within each of the starboard side and port side ballast tanks 8 and ladders permanently or temporarily mounted between these flats 6.

However, the following problems are found in each inspecting system mentioned above.

(1) In case of the first RAFT system, it can not be used in the ballast tank 8 shown in FIG. 13. This is because the distance between the side shell plating 1 and the longitudinal bulkhead 5 is too short to use the system. In addition, it is difficult to shift the RAFT in the spaces between web frame 9 because they are formed in each frame spaces.

Therefore the RAFT system can be used only in cargo tank 7 or in big spaces as in a single hull tanker.

However even in such suitable cases, it is impossible to carry out the inspection for lack of water when the ship is in a dock. In addition, although the inspection may be possible while being anchored or while underway, this is possible only when the waves are low. Also, it is difficult to finely adjust the water level to be suited for the inspection and therefore a detailed inspection cannot be carried out. In addition, a repair cannot be carried out even if it is found that the repair is necessary as a result of the inspection.

(2) In case of the second fixed-ladder system, the ladder must be arranged over the whole region to be inspected and is therefore expensive. In addition, inspection operation through up and down movement of a worker on the ladder requires heavy labor, and the inspection cannot be carried out at any region wherein the ladder is not arranged.

(3) In case of the third temporary scaffold system, the inspection operation can be carried out only when the ship is in a dock and cannot be carried out on the sea. Also, the cost for carrying out the inspection using this system is extremely expensive.

(4) In case of the fourth fiat system, the cost is very expensive since the flats must be formed as part of the hull. In addition, since separate ladders are required in the flats arranged at an upper region of the hull, the cost is expensive when the ladders are permanently mounted and the labor of workers becomes heavy when the ladders are temporarily mounted.

It is therefore an object of the present invention to solve the problems mentioned above. That is, it is an object of the present invention to provide a working apparatus traveling through a tank web frame of a ship which can transport workers or necessary articles to a working place to be inspected or repaired for carrying out the inspection and/or repair within tanks of a ship.

SUMMARY OF THE INVENTION

For achieving the object mentioned above, there is provided, according to the present invention, a working apparatus traveling through the tank web frame of a ship, comprising openings formed as trolley access holes in tank web frame of a ship, a rail passed through said openings and secured to said tank web frame, a trolley adapted to travel along said rail, a hoist mounted on said trolley, and a gondola elevatably suspended from said hoist. In addition, said openings are gondola access holes and have sizes big enough to pass said gondola with trolley therethrough. Said openings may have sizes small enough only to pass said trolley therethrough.

According to the present invention, since the working apparatus comprises openings formed as trolley access holes in tank web frame of a ship, a rail passed through said openings and secured to said tank web frame, a trolley adapted to travel along said rail, a hoist mounted on said trolley, and a gondola elevatably suspended from said hoist, it is possible to carry out the inspection and/or repair by moving the trolley to a working position within the tank to be inspected and/or repaired and then by controlling the height of the gondola loaded with worker (or workers) and necessary articles. Accordingly, it is possible to easily arrange the present working apparatus to a desired position for carrying out the inspection and/or repair within the tank of a ship. Specially, if said openings are gondola access holes and have sizes big enough to pass said gondola with trolley therethrough, it is possible to move the gondola without detaching from trolley to a working position and therefore it is possible to carry out the inspection more easily. And if said openings have sizes small enough only to pass said trolley therethrough, it is possible to move the gondola by detaching from trolley to a working position and therefore it is possible to carry out the same inspection without preparing big openings in the web frame.

In addition, there is provided, according to the present invention, a working apparatus traveling through the tank web frame of a ship, traveling on longitudinal frames arranged on inner surfaces of side shell plating or on longitudinal bulkhead characterized in that each of said longitudinal frames comprises a web plate (web plate) one end of which is secured on the inner surface of side shell plating or on the longitudinal bulkhead and a face plate (face plate) vertically secured on the other end of said web plate; and that said working apparatus comprises one or more traveling wheels traveling on said web plate of said longitudinal frame; a supporting member for rotatably supporting said traveling wheels; a main member arranged perpendicularly to said supporting member, one end of which is secured to said supporting member and the other end of which supports a sheave; a vertical member, one end of which is secured directly to an bottom surface of said main member or to a member connected to said bottom surface near said supporting member and the other end of which extends to a lower longitudinal frame arranged below said longitudinal frame; one or more lower guide wheels mounted on said other end of said vertical member at a position facing toward a face plate of said lower longitudinal frame and adapted to travel thereon; a guide apparatus mounted on a member connected to said main member and having one or more upper guide wheels adapted to travel on a surface of said face plate facing toward said web plate; a traveling drive apparatus mounted on said main member for driving said traveling wheels; and a hoist apparatus mounted on said main member for elevating an object to be hoisted via said sheave.

Said face plate of said longitudinal frame is mounted on the other end of said web plate in a T-shaped manner, and said guide apparatus is mounted on said supporting member and has one or more upper guide wheels traveling on an upper-half surface of said face plate facing toward the web plate.

Said face plate of said longitudinal frame is mounted on said other end of said web plate at lower side thereof; said guide apparatus has one or more upper guide wheels traveling on a surface of said face plate facing toward the web plate, a guide wheel supporting member mounted directly on said vertical member or on a member connected to said vertical member and adapted to vertically and slidably supporting said upper guide wheels, and a vertically driving apparatus for vertically moving said upper guide wheels.

The working apparatus of the present invention travels on the horizontal portion (web plate) of the longitudinal frames via the traveling wheels rotatably supported on the supporting member. The vertical member is secured to the bottom of the main member arranged perpendicularly to the supporting member. The lower guide wheel is mounted on the bottom end of the vertical member such that it can contact with the face plate of the lower longitudinal frame and rotate thereon, and the upper guide wheel is mounted on the member connected to the main member such that it can contact with the face plate of said longitudinal frame (i.e. the upper longitudinal frame) facing toward the web plate thereof and rotate thereon. This makes it possible that the traveling wheels travel on the web plate of the longitudinal frame without derailing therefrom against a moment acting on the working apparatus and caused by the object suspended via the sheave mounted on the distal end of the main member and also against a horizontal force directing toward the sheave on the main member. The traveling wheels are driven by the traveling drive apparatus and the object to be hoisted is elevated by the hoist apparatus via the sheave mounted on the distal end of the main member.

The longitudinal frame includes two types, i.e. one of which is that the face plate is mounted to the web plate in a T-shaped manner and the other is that the face plate is mounted to the web plate in a L-shaped manner. In case of the T-shaped type, the upper guide wheel is mounted on the supporting member such that it contacts with and travels on the upper-half surface of said face plate facing toward the web plate. The working apparatus can be easily mounted on the longitudinal frame by suspending the working apparatus upward so that the upper guide wheel is positioned slightly higher than the face plate of the longitudinal frame and then by lowering the working apparatus so that the upper guide wheel is laid on the surface of the face plate facing toward the web plate. This eliminates the necessity of providing the present working apparatus in each frame space of tanks and makes it possible to transport the present apparatus to any desired frame space of the tanks.

On the other hand, in case of the L-shaped type wherein the face plate of the longitudinal frame is arranged under the web plate, the working apparatus can be mounted on the longitudinal frame in a similar manner as the T-shaped type by elevating the working apparatus so that the upper guide wheel is positioned slightly higher than the web plate of the longitudinal frame, then by laying the traveling wheels on the web plate with shifting the upper guide wheel to a surface of the face plate facing toward the web plate, and finally pushing the upper guide wheel by the vertically driving apparatus so that the upper guide wheel contacts with the surface of the face plate facing toward the web plate. This also makes it possible to transport the present apparatus to any desired frame space of the tanks.

Further objects, features and advantages of the present invention will become apparent from the Detailed Description of Preferred Embodiments when considered together with the attached Drawings.

DETAILED DESCRIPTION OF THE PREFERRED EMBODIMENTS

Preferred embodiments of the present invention will be hereinafter described with reference to the accompanying drawings.

Figure 1:
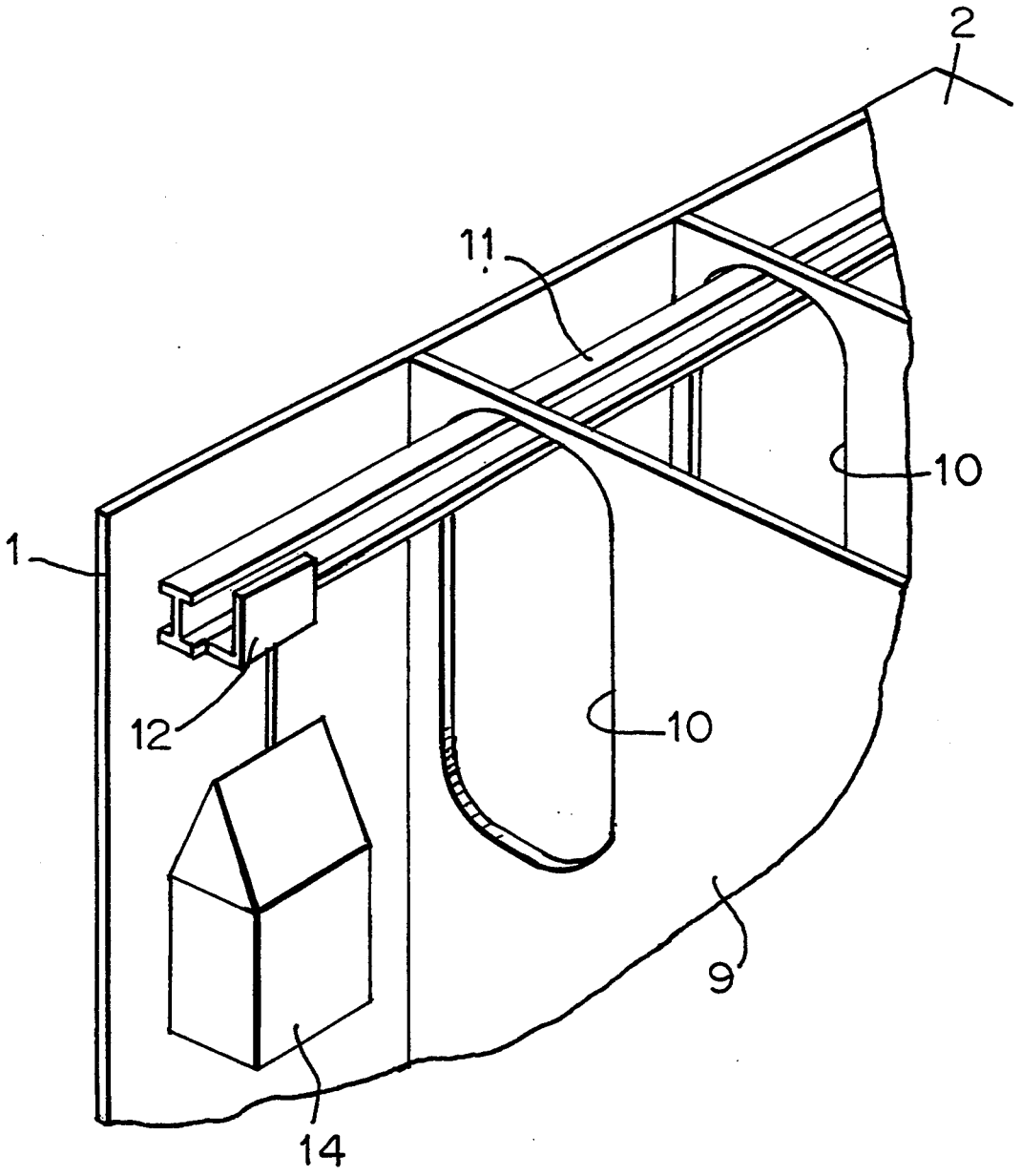
FIG. 1 is a partially broken perspective view showing a working apparatus of a first embodiment of the present invention.
Figure 2:
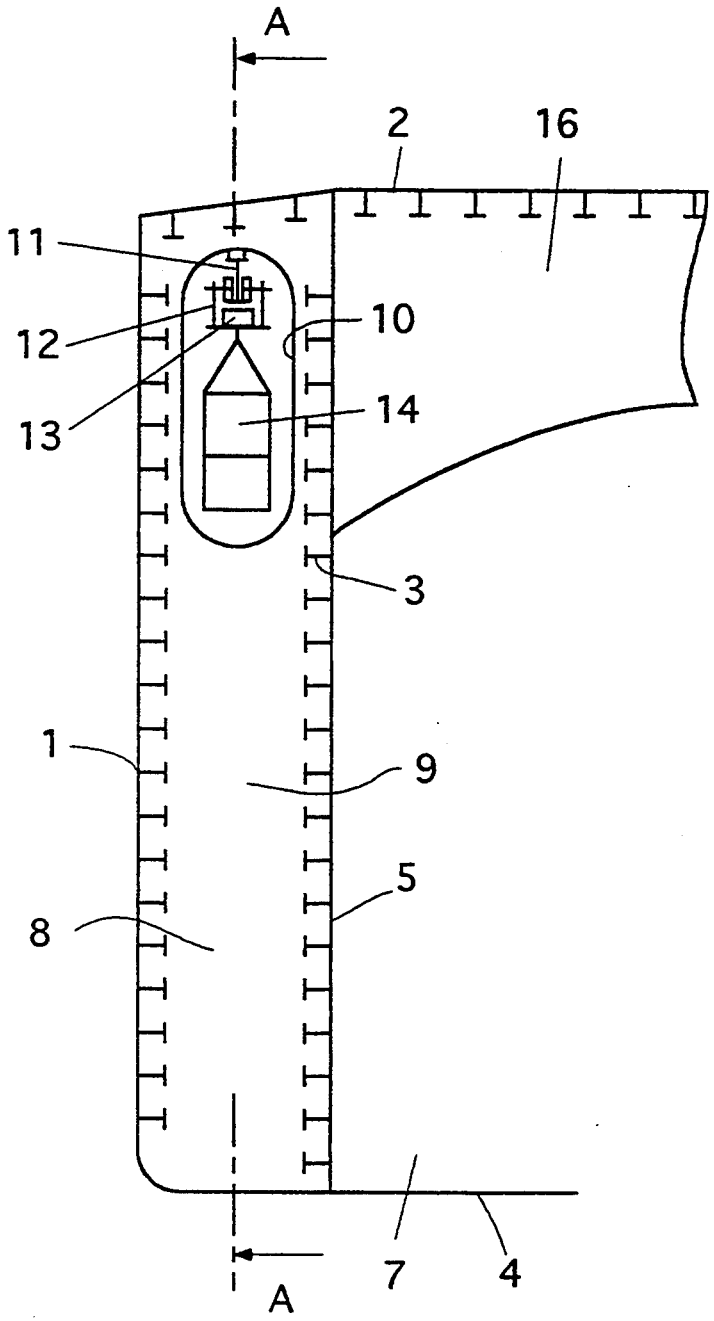
FIG. 2 is a front elevational cross-section view showing the working apparatus mounted on the rail.
Figure 3:
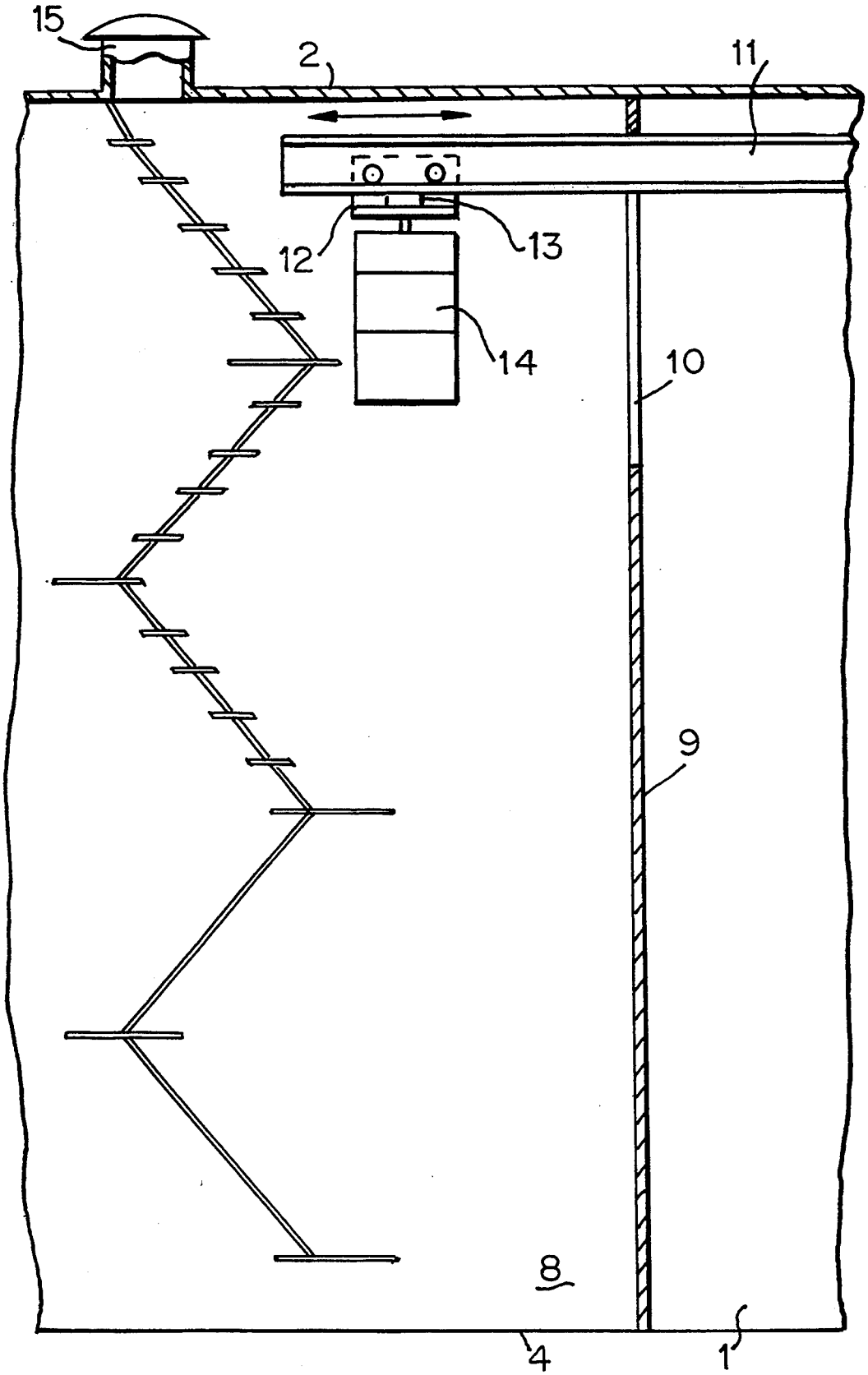
FIG. 3 is a side elevational view taken along a line A—A in FIG. 2.
Figure 13:
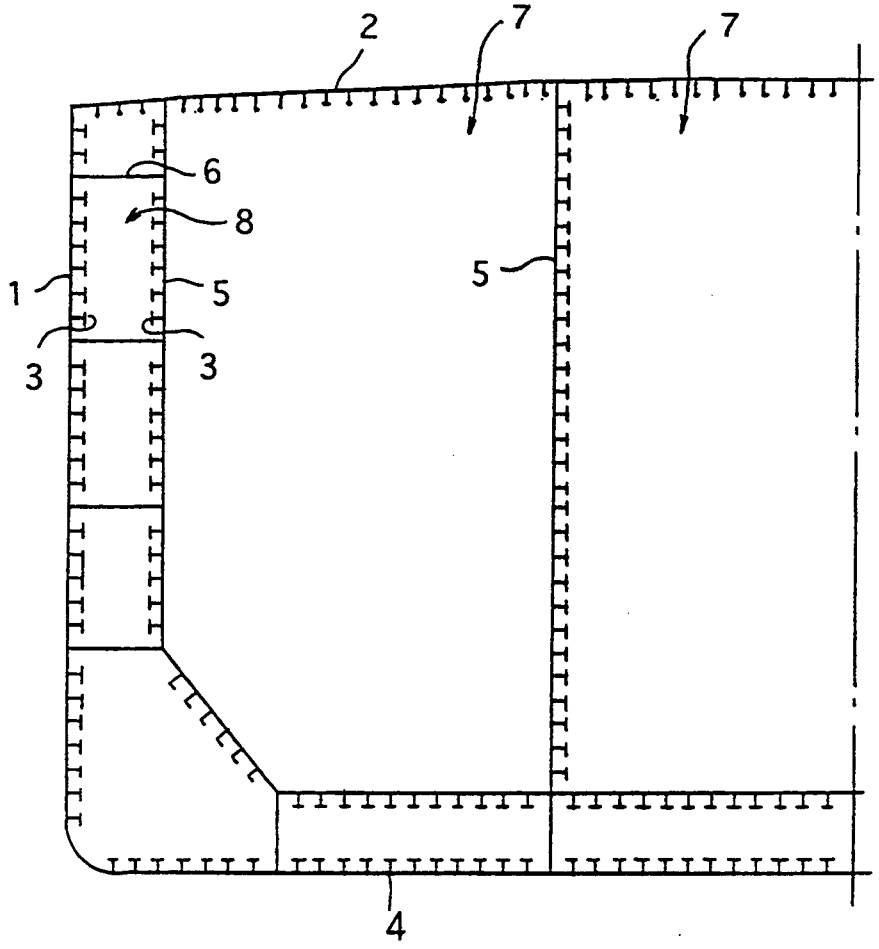
FIG. 13 is a view showing a cross-section of a middle hull of a large tanker.

FIG. 1 to FIG. 3 show a first embodiment of the present invention wherein FIG. 1 is a partially broken perspective view, FIG. 2 is a partial front elevational cross-section view, and FIG. 3 is a side elevational view taken along a line A—A in FIG. 2. Reference numerals 1 to 5, 7 and 8 used in FIG. 1 to FIG. 3 denote same components as those shown in FIG. 13.

A reference numeral "9" denotes web frame of tanks, "10" denotes openings formed as gondola access holes in tank web frame 9 of a ship, "11" denotes a rail passed through the openings 10 and secured to the tank web frame 9, "12" denotes a trolley adapted to travel along the rail 11, "13" denotes a hoist mounted on the trolley 12, "14" denotes a gondola elevatably suspended from the hoist 13, and "15" denotes a hatch. Hoist 13 can be mounted in gondola 14 instead of trolley 12. The rail 11 is preferably a monorail, but a double-rail can be used for the rail 11. In the case using the double-rail, it is possible to use some mechanism to move the gondola 14 near to a plating for inspection and some moment produced by the mechanism could be supported by the double-rail.

As shown in the first embodiment, in the case of a ballast tank in a double hull, gondola access holes having sizes big enough to pass the gondola therethrough can be easily prepared in upper part of the tank web frame 9. Conventional tank web frame 9 has only small holes therein. However it is possible to prepare the gondola access holes in upper part of the tank web frame 9, because the upper part is over the water level and therefore the water pressure and stress thereby are small. In addition, because the gondola access holes 10 is positioned over the lowest part of the deck trans-member 16 in cargo tank 7, the tank web frame 9 having the gondola access holes 10 can support against the force by the deck trans-member 16. Accordingly, gondola access holes 10 can be easily provided in the tank web frame 9 without changing the design so much, and therefore the working apparatus can be easily adopted to presently working ships.

In the working apparatus shown in FIG. 1 to FIG. 3, it is possible to carry out the inspection and/or repair by moving the trolley 12 fore and aft to a working position within the ballast tank 8 to be inspected and/or repaired and then by controlling the height of the gondola 14 up and down loaded with worker (or workers) and necessary articles.

More in detail, it is preferable that the rail 11 is a permanently installed type and a landing flat of a companionway is enlarged to utilize this landing flat as a space for mounting the trolley 12 and gondola 14. Also it is preferable to make the trolley 12 and the gondola 14 light-weight and small to be suited for handling by a worker and to make the size of access holes 15 as small as possible, where the trolley 12 and the gondola 14 are brought in the ballast tank 8 through access hole 15.

The working apparatus of the present invention is installed and operated as follows; firstly mounting the trolley 12 and the hoist 13 on the rail 11 at the landing flat of the companionway, then mounting the gondola 14 on the hoist 13, loading a worker and necessary articles on the gondola 14, and the worker riding on the gondola 14 operating a remote-control operating pendant to transport the working apparatus to a desired position.

That is, if said openings 10 are gondola access holes and have sizes big enough to pass said gondola 14 therethrough, it is possible to move the gondola 14 without detaching from trolley 12 to a working position and therefore it is possible to carry out the inspection more easily.

Figure 4:
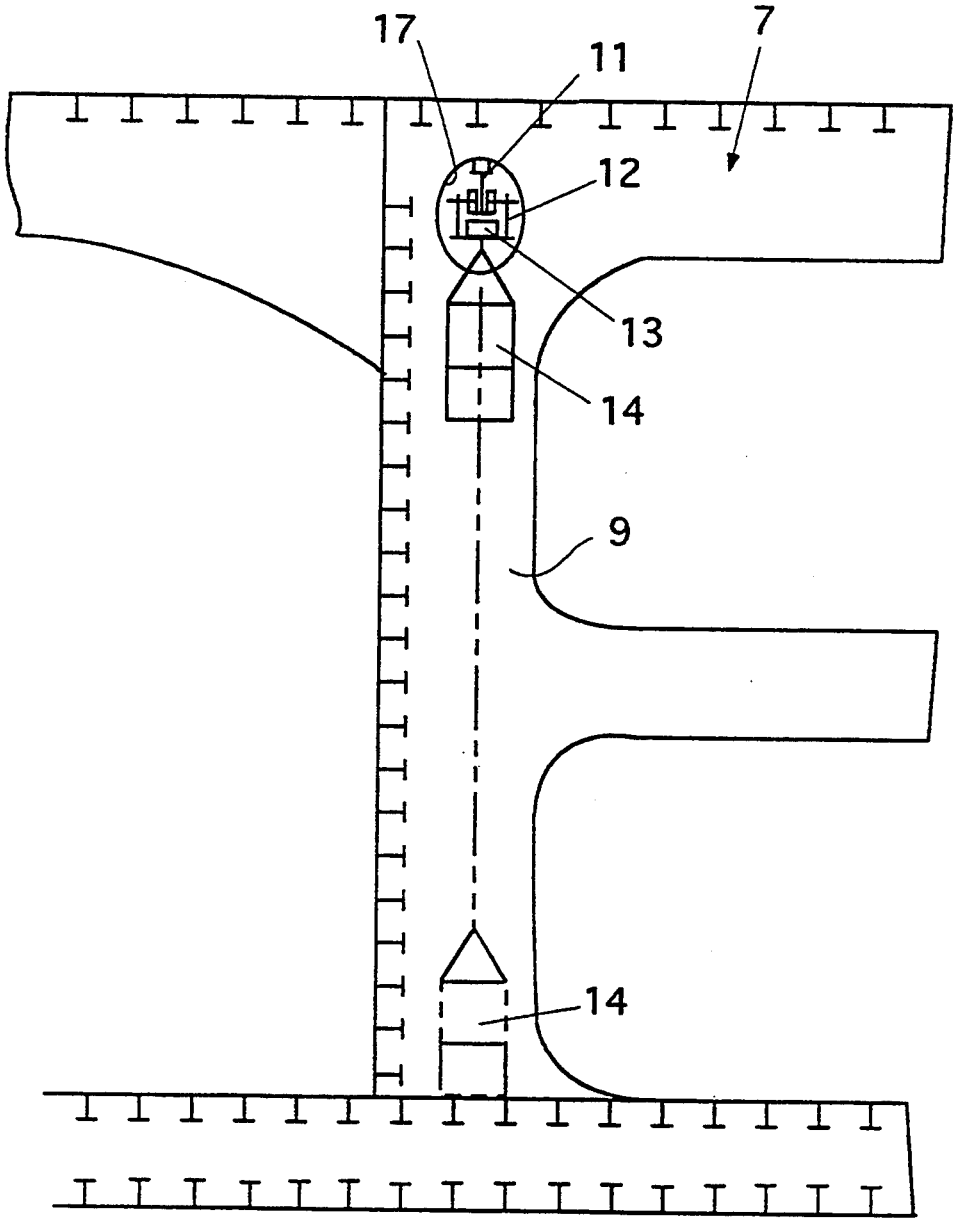
FIG. 4 is a partial front elevational cross-section view applied the present invention to a cargo tank 7.

Although the tank 8 shown in FIG. 1 to FIG. 3 is the ballast tank, it should be noted that the present invention can be also applied to the cargo tank 7. FIG. 4 is a partial front elevational cross-section view, similar to FIG. 2, applied the present invention to a cargo tank 7.

In FIG. 4, reference numeral "9" denotes a web frame of tanks, "17" denotes openings formed as trolley access holes in tank web frame 9 of the ship, "11" denotes a rail passed through the openings 17 and secured to the tank web frame 9, "12" denotes a trolley adapted to travel along the rail 11, "13" denotes a hoist mounted on the trolley 12, and "14" denotes a gondola elevatably suspended from the hoist 13. The openings 17 are different from the opening 10 because the openings 17 have sizes small enough only to pass the trolley 12 therethrough. That is, it is preferable that the trolley 12 and the hoist 13 are as small as possible and light-weight, and the opening 17 are as small as possible.

In the working apparatus shown in FIG. 4, it is possible to carry out the inspection and/or repair by moving the trolley 12 fore and aft to a working position within the cargo tank 7 to be inspected and/or repaired and then by controlling the height of the gondola 14 up and down loaded with worker (or workers) and necessary articles. In FIG. 4, as the gondola 14 can not pass through the openings 17, at first the gondola 14 is lowered to the bottom of the ship by the hoist 13, then the gondola 14 is detached from the trolley 12 and moved to next working position by workers, and then the gondola 14 is lifted up again by the hoist 13 which is passed through the opening 17. Therefore, even if the openings 17 have small sizes enough only to pass the trolley therethrough, it is possible to move the gondola 14 by detaching from trolley 12 to a working position and to carry out the inspection without preparing big openings in the web frame 9.

Figure 5:
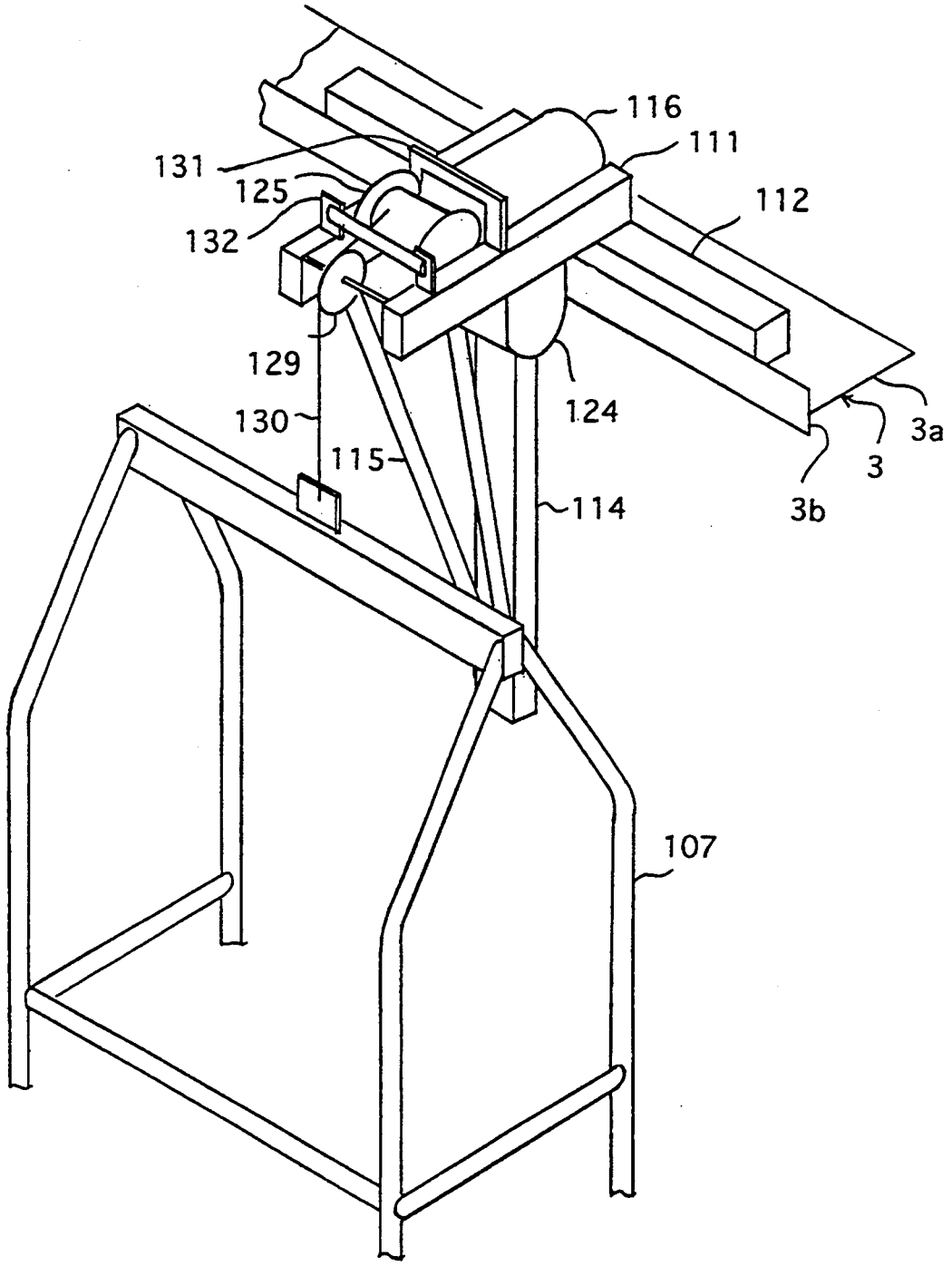
FIG. 5 is a perspective view showing a working apparatus of a second embodiment of the present invention mounted on the longitudinal frame and suspending a working gondola therefrom.
Figure 6:
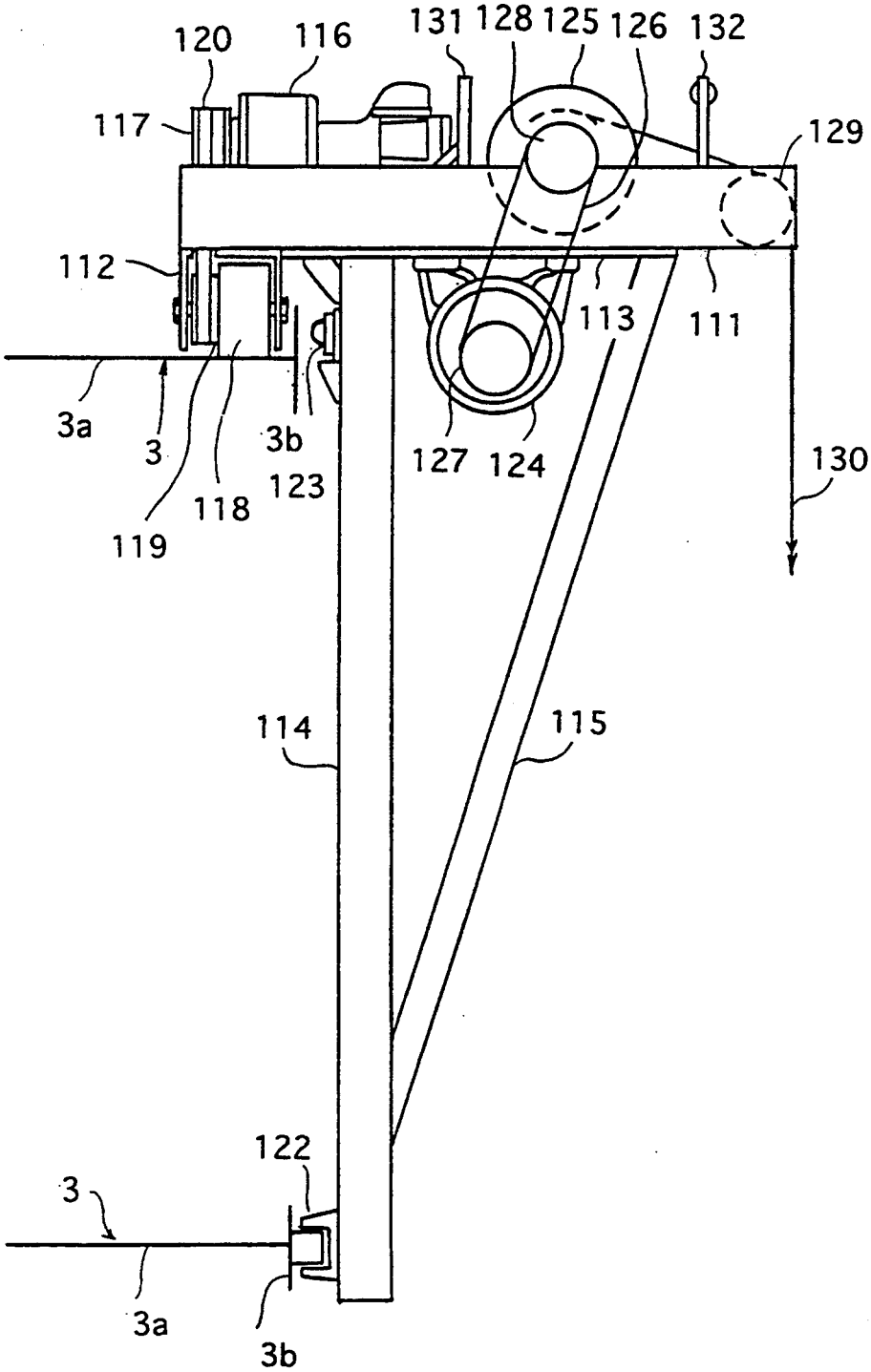
FIG. 6 is a side elevational view of the second embodiment.
Figure 7:
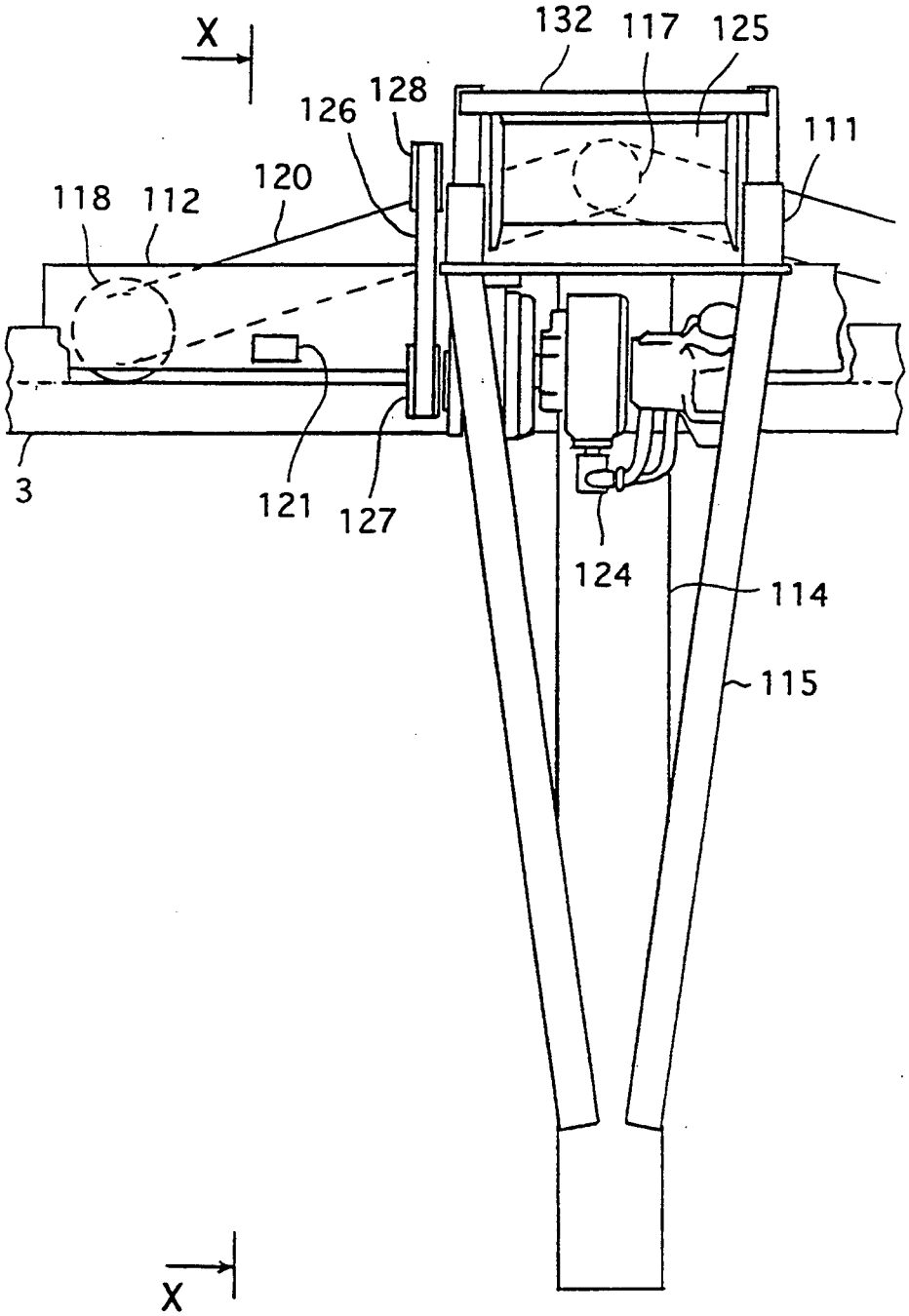
FIG. 7 is a front elevational view of the second embodiment.
Figure 8:
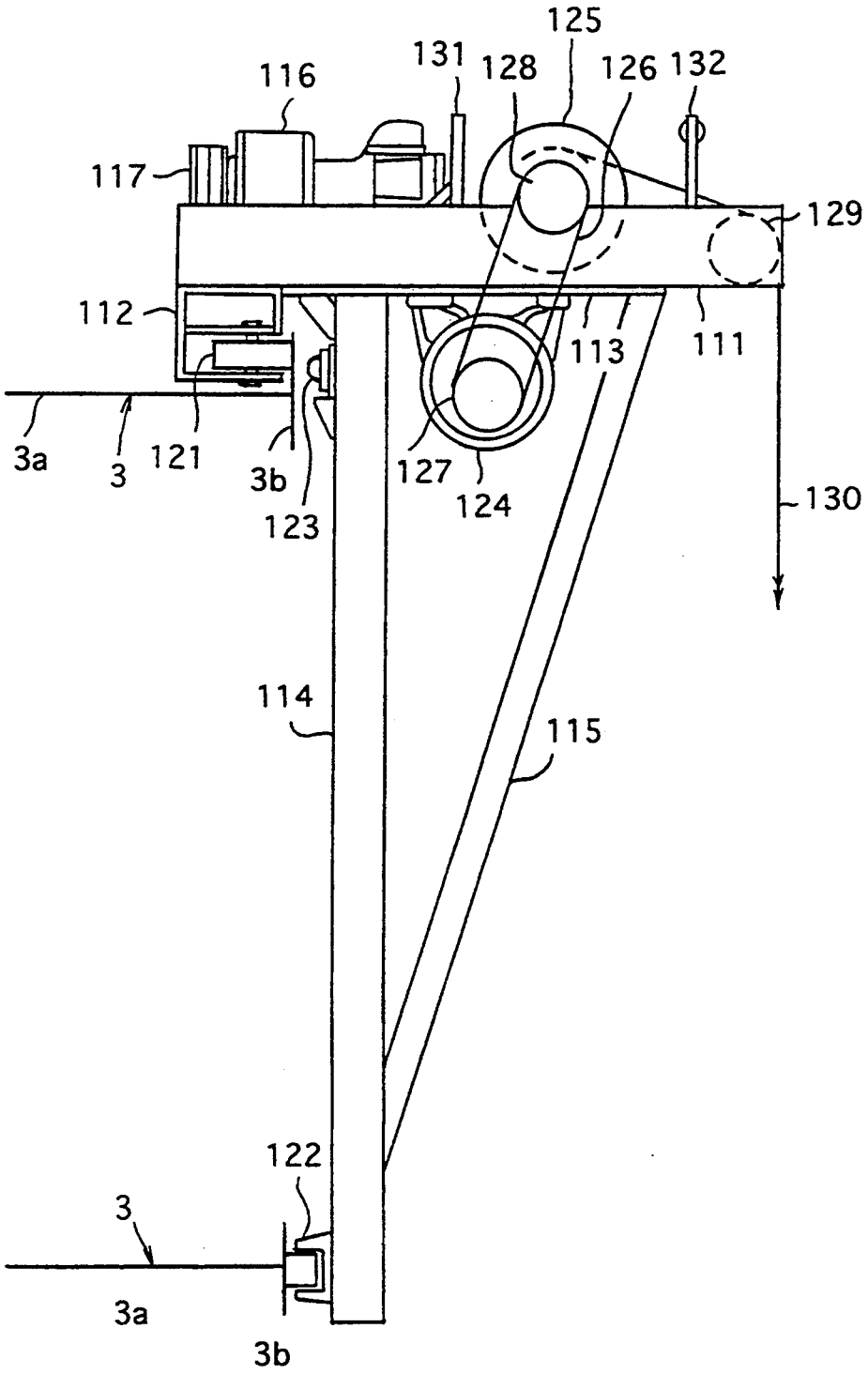
FIG. 8 is a view taken along a line X—X in FIG. 7.
Figure 9:
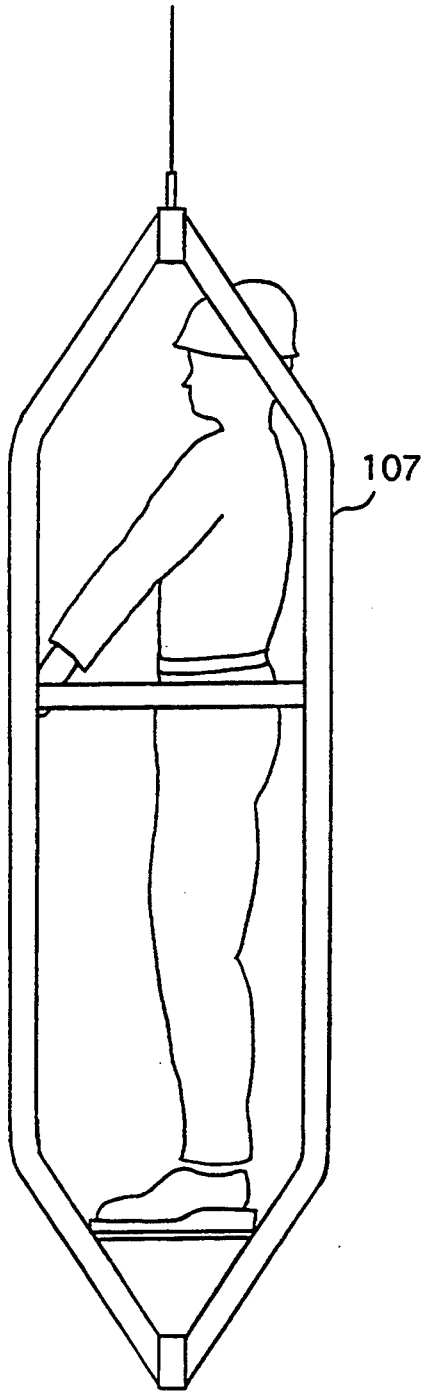
FIG. 9 is a view showing a suspended gondola loading a worker thereon.
Figure 10:
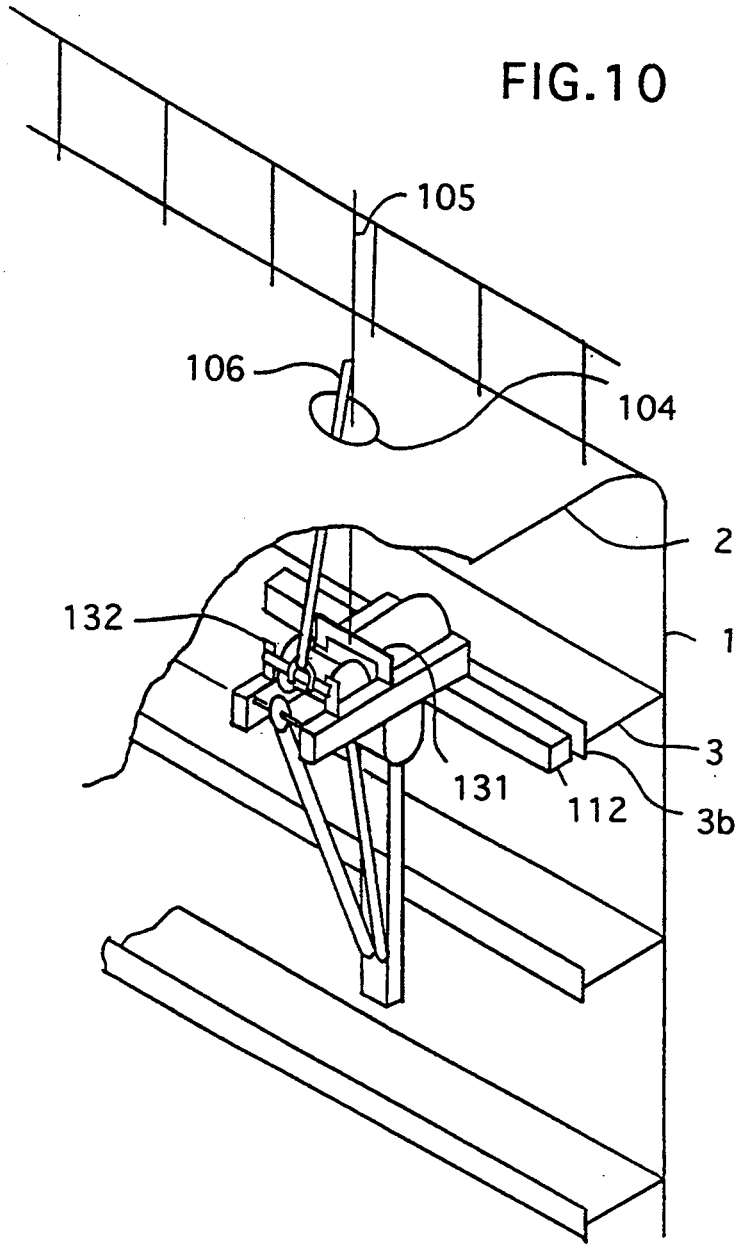
FIG. 10 is an explanatory view of mounting the working apparatus of the second embodiment on a longitudinal frame of a side shell plating.

FIG. 5 is a perspective view of a second embodiment of the present invention showing a condition mounted on the longitudinal frame and a gondola suspended therefrom. FIG. 6 is a side elevational view of the second embodiment of FIG. 5. FIG. 7 is a front elevational view of the second embodiment of FIG. 5. FIG. 8 is a view taken along a line X—X in FIG. 7. FIG. 9 shows a gondola suspended by the present working apparatus and riding thereon a worker. FIG. 10 is a schematic view showing a method of mounting the present working apparatus on the longitudinal frame of the side shell plating.

The second embodiment is a working apparatus (hereinafter referred to as "present apparatus") which is intended to travel on a longitudinal frame 3 comprising a web plate 3*a* (horizontal portion) and a face plate 3*b* (vertical portion) in which the face plate 3*b* is mounted on the web plate 3*a* in a T-shaped manner.

As shown in FIGS. 6, 7 and 8, each end of two main members 111 is connected to a supporting member 112 perpendicularly arranged thereto and the bottom surfaces of the main members 111 are connected to each other by a supporting plate 113. A vertical member 114 is secured to the bottom surface of the supporting plate 113 at a center of the two main members 111 and is reinforced by a diagonal member 115 as shown in FIG. 6. A traveling drive apparatus 116 is mounted on the upper surface of the supporting plate 113 to which the vertical member 114 is secured. The traveling drive apparatus 116 has a pneumatic motor driven by compressed air and a reduction gear and a pulley 117 is connected to an output shaft of the reduction gear. Traveling wheels 118 are mounted on opposite ends of the supporting member 112 and a pulley 119 is secured to a shaft of each traveling wheel 118. The pulley 117 and the pulley 119 of each traveling wheel 118 are connected via belts 120 so as to transmit a driving force between them. Sprockets and chains may be used in place of the pulleys 117 and 119 and the belts 120 respectively.

As shown in FIG. 8, an upper guide wheel (or wheels) 121 is mounted on the supporting member 112 and the upper guide wheel 121 acts against a moment caused by a gondola 107 suspended by the present working apparatus and also against a horizontal force directing toward a sheave 129 on the main member. A lower guide wheel (or wheels) 122 is mounted on the bottom end of the vertical member 114 at a position corresponding to a face plate 3*b* of a lower longitudinal frame 3 positioned below the longitudinal frame 3 on which the wheels 118 travel so that the lower guide wheel 122 can contact with and travel on the face plate 3*b* of the lower longitudinal frame 3 in order to resist against a moment caused by the suspended gondola 107. A ball-socket fitting 123 is mounted on the vertical member 114 at a position facing to the face plate 3*b* of the (upper) longitudinal frame 3 so as to have a smooth contact between the vertical member 114 and the face plate 3*b* of the longitudinal frame 3.

A hoist apparatus 124 is mounted on the bottom surface of the supporting plate 113 and is adapted to drive a drum 125 mounted on the top surface of the main member 111. The hoist apparatus 124 is formed by a pneumatic motor and reduction gear unit driven by compressed air and transmit a power between a pulley 127 secured to an output shaft of the reduction gear and a pulley 128 secured to the drum 125 via a belt 126. The pneumatic motor of the hoist apparatus 124 is provided with a brake so as to prevent the falling of the gondola 107 even if the air supply would be abruptly stopped. Sprockets and a chain may be used in place of the pulleys 127, 128 and the belt 126. The sheave 129 mounted on the distal end of the main members 111 guides a wire rope 130 from the drum 125. A suspension fitting 131 is mounted on the top surface of the main members 111 at a gravity center of the present apparatus. A mounting fitting 132 used for mounting the present apparatus on the longitudinal frame 3 is mounted on the main members 111 between the drum 125 and the sheave 129. The compressed air is supplied to the traveling drive apparatus 116 and the hoist apparatus 124 via air hoses (not shown) and the control thereof is carried out by using an operating pendant (not shown).

As shown in FIG. 9, the present working apparatus suspends the gondola 107 for loading a worker (or workers). The working apparatus is controlled in its height and travel by operating the operating pendant to carry out the inspection and/or repair of the structure within the tanks. The gondola 107 has a light-weight structure substantially formed by pipes of a circular cross-section and has a dimension able to be entered into a tank through a hatch thereof.

A method of how to install the present working apparatus on the longitudinal frame 3 will be then described with reference to FIG. 10. The present apparatus and the gondola 107 are once carried into the bottom of a tank through a hatch thereof and are then moved to a desired frame space along the bottom of the tank. When the tank is divided into several frame spaces, the present apparatus and the gondola 107 can be moved to an adjacent frame space through an access hole formed in the frame space wall. It is preferable to form an opening 104 having a diameter of 200 to 300 mm in a deck 2 at a position desired to mount the present apparatus therethrough. The present apparatus is suspended along the longitudinal frame 3 of the side shell plating 1 with hooking a wire rope 5 passed through the opening 104 on the suspension fitting 131 and then is stopped at a position of the longitudinal frame 3 on which the present apparatus is mounted. Thus the present apparatus can be mounted on the longitudinal frame by hooking a mounting jig 106 on the mounting fitting 132 to lift the side of the supporting member 112 on which the traveling wheels 118 are mounted and then by positioning the supporting member 112 inside the face plate 3*b* (i.e. at a side of the face plate 3*b* facing toward the side shell plating 1 in this case).

One example of operating steps of carrying into the tank, mounting on the longitudinal frame 3, suspending and traveling of the present working apparatus is as follows.

(1) Carrying the present apparatus and the gondola 107 into the tank;

(2) Lowering the wire rope 105 through the opening 104 in the deck and connecting it to the present apparatus;

(3) Elevating the present apparatus to a position just under the deck 2 and connecting the air hoses to the traveling drive apparatus 116 and the hoist apparatus 124;

(4) Lowering the present apparatus to the position of the longitudinal frame 3 to which the present apparatus is to be mounted and then laying the present apparatus on the longitudinal frame with the use of the mounting jig 106;

(5) Slackening the wire rope 105 used for suspending the present apparatus by a length allowing the present apparatus to travel;

(6) Operating the operating pendant from the bottom of the tank to try an examination of travel of the present apparatus;

(7) Lowering the wire rope 130 from the hoist apparatus 124 and connecting it to the gondola 107; and (8) A worker (or workers) riding on the gondola 107 with carrying the operating pendant and operating it so that the present apparatus and the gondola 107 can arrive at a desired position.

Next a third embodiment of the present invention will be described.

Figure 11:
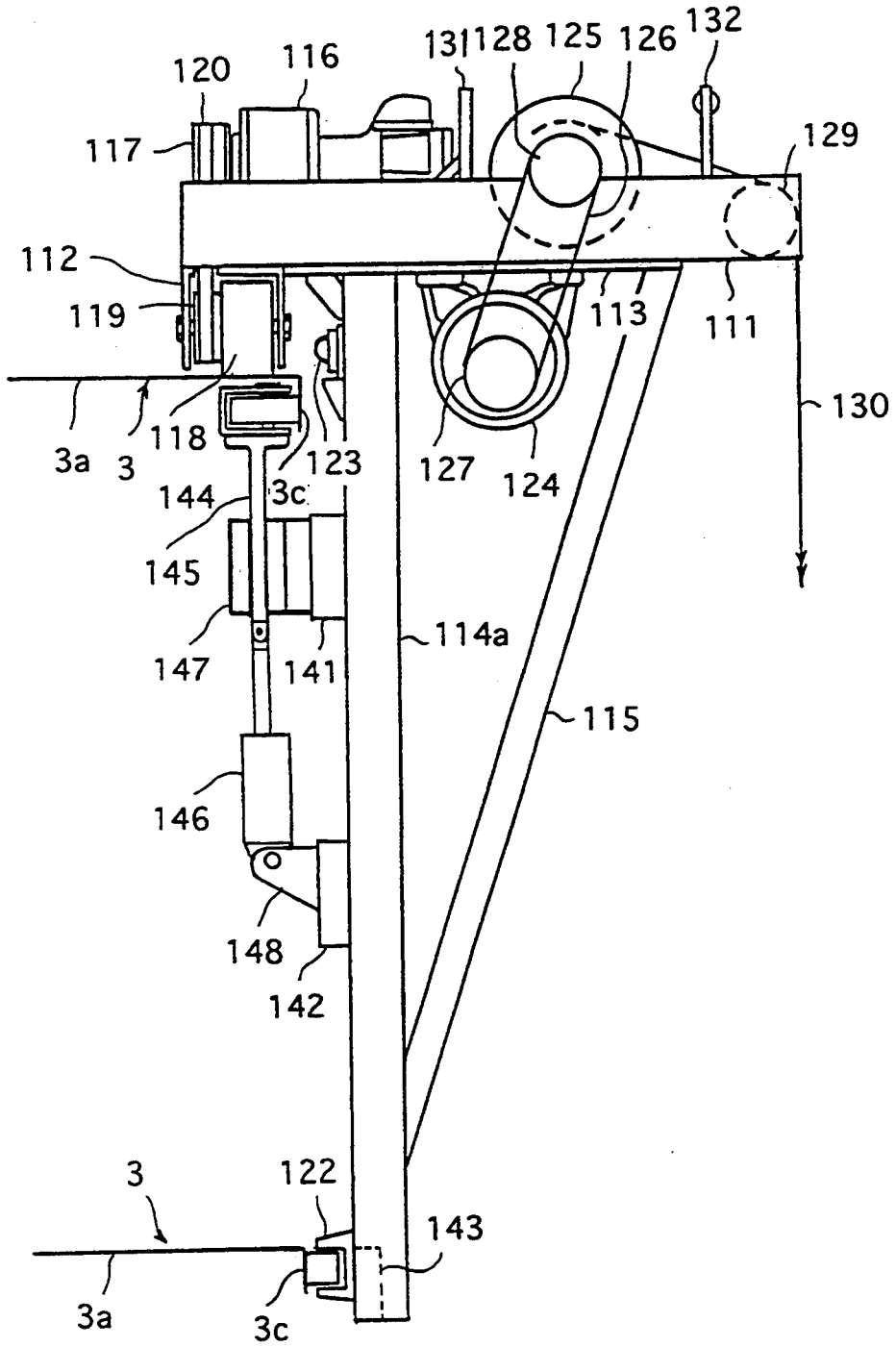
FIG. 11 is a side elevational view of a third embodiment.
Figure 12:
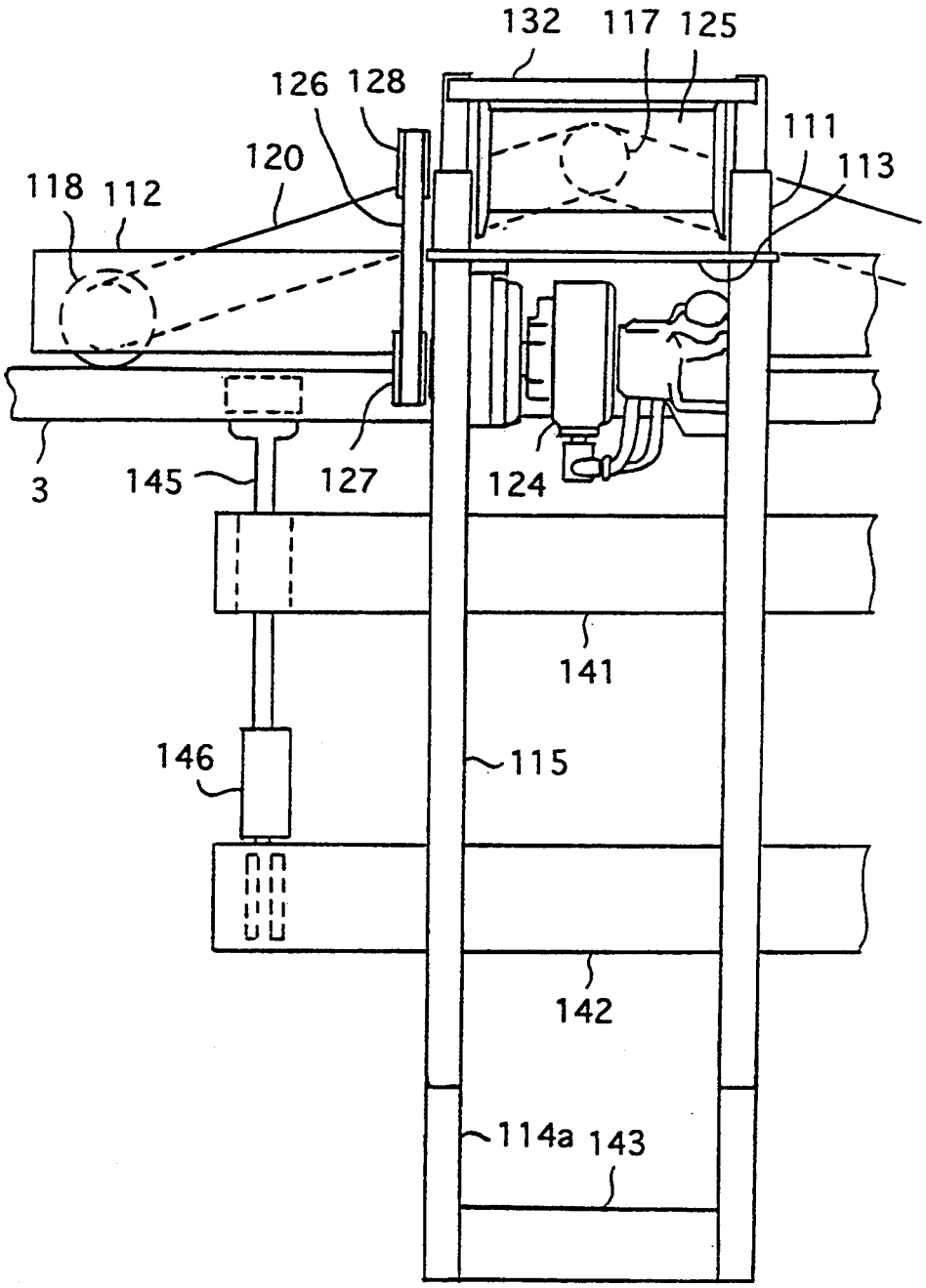
FIG. 12 is a front elevational view of the third embodiment.

This third embodiment is a working apparatus to be used for a longitudinal frame in which a face plate 3*c* is arranged at a lower side of the web plate 3*a* in a L-shaped manner. FIG. 11 is a side elevational view of the present working apparatus and FIG. 12 is a front elevational view thereof. In these drawings, same reference numerals are used for identifying the same parts shown in FIG. 6 to FIG. 8. Two vertical members 114*a* are connected to the under side of the two main members 111 via the supporting plate 113 and the vertical members 114*a* are tied each other by three lateral members 141,142 and 143. Each vertical member 114*a* is provided with the diagonal member 115 and the lower guide wheel 122.

Pneumatic cylinders 146 each having a vertically extendable rod are mounted on the opposite ends of the lateral member 142. An extension rod 145 is connected to each extendable rod and an upper guide wheel 144 is mounted on a distal end of each extension rod 145. The end of the pneumatic cylinder 146 is connected to the lateral member 142 via a supporting bracket 148 and the extension rod 145 is vertically slidably supported by the lateral member 141 via a guide wheel supporting member 147. It is preferable to determine that the stroke of the pneumatic cylinder 146 is longer than the height of the face plate 3*c*. FIG. 11 shows a condition in which the pneumatic cylinder 146 is fully extended and the upper guide wheel 144 is contacted with the face plate 3*c*.

Installation of the present apparatus of the third embodiment is carried out as follows. Firstly, the rod of the pneumatic cylinder 146 is set in a fully retracted condition. Then, as explained with reference to FIG. 10, elevating the present apparatus to a position of the longitudinal frame 3 to which the present apparatus is to be mounted and stopping once the present apparatus at this position. Then, hooking the mounting jig 106 on the mounting fitting 132, laying the traveling wheels 118 on the web plate 3*a* after having inclined the present apparatus so that the side thereof at which the supporting member 112 is mounted is higher than the other side and pulled the traveling wheels 118 toward the fixed base of the longitudinal frame 3, and finally extending the rod of the pneumatic cylinder 146 in order to make a contact of the upper guide wheels 144 with the surface of the face plate 3*c* facing toward the web plate 3*a*. The other operations thereafter are carried out similarly to the second embodiment. The pneumatic cylinder is supplied with compressed air via an air hose similarly to the cases of the traveling drive apparatus 116 and the hoist apparatus 124. These air hoses are slackened in consideration of the traveling range of the present apparatus.

In both the second and third embodiments, any suitable electric motor may be used in place of the pneumatic motors used in the traveling drive apparatus 116 and the hoist apparatus 124.

As can be seen from the description above, according to the present invention, since the working apparatus comprises openings formed as gondola access holes in tank web frame of a ship, a rail passed through the openings and secured to the tank web frame, a trolley adapted to travel along the rail, a hoist mounted on the trolley, and a gondola elevatably suspended from the hoist, it is possible to carry out the inspection and/or repair by moving the trolley to a working position within the tank to be inspected and/or repaired and then by controlling the height of the gondola loaded with worker (or workers) and necessary articles.

Accordingly, the working apparatus of the present invention can be easily transported to a desired position to carry out the inspection and/or repair within the tank of a ship.

That is, the present invention is different from the flat system of the prior art and thus it is possible to eliminate the necessity of providing a horizontal scaffold and therefore to greatly reduce the cost thereof. Also, the absence of the flat makes it possible allow any gas free or allow the carrying-in (or-out) of articles from the ship's bottom. In addition, since the worker can freely travel to a desired position with while riding on the gondola, it is possible to reduce the traveling time and the labor of the worker and to improve the working efficiency. Also, the working apparatus has less susceptibility to falling and is able to carry out its work at any time whether on the sea or on a dock.

In addition, the working apparatus of the present invention which can travel on the longitudinal frame makes the inspection and/or repair works of the inner structure of the tanks easy. In addition, since the mounting and demounting of the present working apparatus can be easily achieved, the maintenance of tank including plural tank web frames can be achieved by using the single present apparatus. The present apparatus can achieve an easy and shorter time of inspection as compared with any conventional inspection system and has less susceptibility to falling and can reduce the cost required for carrying out the inspection and/or repair.

While the present invention has been illustrated by means of several preferred embodiments, one of ordinary skill in the art will recognize that modification, addition and improvements can be made while remaining within the scope and spirit of the present invention. The scope of the present invention is determined solely by the appended claims.

What is claimed is:

1. A working apparatus for traveling through a tank web frame of a ship, comprising openings formed as trolley access holes in the tank web frame of the ship, a rail passed through the openings and secured to the tank web frame, a trolley adapted to travel along the rail, a hoist mounted on the trolley, and a gondola elevatably suspended from the hoist.

2. A working apparatus of claim 1 wherein said openings are gondola access holes and have sizes big enough to pass said gondola and trolley therethrough.

3. A working apparatus of claim 1 wherein said openings have sizes small enough only to pass said trolley therethrough.

4. A working apparatus for traveling through a tank web frame of a ship, traveling on longitudinal frames arranged on inner surfaces of side shell plating characterized in that:

each said longitudinal frame comprises a web plate one end of which is secured on the inner surface of side shell plating and a face plate is vertically secured on the other end of said web plate; and said working apparatus comprises:

at least one traveling wheel traveling on said web plate of said longitudinal frame;

a supporting member for rotatably supporting said traveling wheel;

a main member arranged perpendicularly to said supporting member, one end of which is secured to said supporting member and the other end of which supports a sheave;

a vertical member, one end of which is secured to a bottom surface of said main member, and the other end of which extends to a lower longitudinal frame arranged below said longitudinal frame;

at least one lower guide wheel mounted on said other end of said vertical member at a position facing toward a face plate of said lower longitudinal frame and adapted to travel thereon;

a guide apparatus mounted on a member connected to said main member and having at least one upper guide wheel adapted to travel on a surface of said face plate facing toward said web plate;

a traveling drive apparatus mounted on said main member for driving said traveling wheel; and a hoist apparatus mounted on said main member for elevating an object to be hoisted via said sheave.

5. A working apparatus of claim 4 wherein said face plate of said longitudinal frame is mounted on the other end of said web plate in a T-shaped manner, and said guide apparatus is mounted on said supporting member and has at least one upper guide wheels traveling on an upper-half surface of said face plate facing toward the web plate.

6. A working apparatus of claim 4 wherein said face plate of said longitudinal frame is mounted on said other end of said web plate at a lower side thereof; said guide apparatus has at least one upper guide wheel traveling on a surface of said face plate facing toward the web plate, a guide wheel supporting member mounted on said vertical member and adapted to vertically and slidably supporting said upper guide wheel, and a vertically driving apparatus for vertically moving said upper guide wheel.

7. A working apparatus for traveling through a tank web frame of a ship, traveling on longitudinal frames arranged on longitudinal bulkhead, characterized in that:

each of said longitudinal frame comprises a web plate one end of which is secured on the longitudinal bulkhead and a face plate is vertically secured on the other end of said web plate; and said working apparatus comprises:

at least one traveling wheel traveling on said web plate of said longitudinal frame;

a supporting member for rotatably supporting said traveling wheel;

a main member arranged perpendicularly to said supporting member, one end of which is secured to said supporting member and the other end of which supports a sheave;

a vertical member, one end of which is secured to a bottom surface of said main member and the other end of which extends to a lower longitudinal frame arranged below said longitudinal frame;

at least one lower guide wheel mounted on said other end of said vertical member at a position facing toward a face plate of said lower longitudinal frame and adapted to travel thereon;

a guide apparatus mounted on a member connected to said main member and having at least one upper guide wheel adapted to travel on a surface of said face plate facing toward said web plate;

a traveling drive apparatus mounted on said main member for driving said traveling wheel; and a hoist apparatus mounted on said main member for elevating an object to be hoisted via said sheave.

8. A working apparatus of claim 4 wherein said one end of said vertical member is secured to said bottom surface by means of a member connected to said bottom surface near said supporting member.

9. A working apparatus of claim 7 wherein said one end of said vertical member is secured to said bottom surface by means of a member connected to said bottom surface near said supporting member.

10. A working apparatus of claim 7 wherein said face plate of said longitudinal frame is mounted on said other end of said web plate at a lower side thereof; said guide apparatus has at least one upper guide wheel traveling on a surface of said face plate facing toward the web plate, a guide wheel supporting member mounted on said vertical member and adapted to vertically and slidably supporting said upper guide wheel, and a vertically driving apparatus for vertically moving said upper guide wheel.

11. A working apparatus of claim 6 wherein said guide wheel supporting member is mounted on said vertical member by means of a member connected to said vertical member.

12. A working apparatus of claim 10 wherein said guide wheel supporting member is mounted on said vertical member by means of a member connected to said vertical member.

* * * * *